US006308550B1

(12) United States Patent
Papesh

(10) Patent No.: US 6,308,550 B1
(45) Date of Patent: Oct. 30, 2001

(54) MODULAR MOBILE AUTOMOTIVE DESIGN BRANCH

(76) Inventor: Thomas S. Papesh, 121 S. Joliet Rd., Plainfield, IL (US) 60544

( * ) Notice: Subject to any disclaimer, the term of this patent is extended or adjusted under 35 U.S.C. 154(b) by 0 days.

(21) Appl. No.: 09/550,060

(22) Filed: Apr. 14, 2000

(51) Int. Cl.[7] ..... B21D 1/12
(52) U.S. Cl. ..... 72/305; 72/705
(58) Field of Search ..... 72/705, 305; 33/608

(56) References Cited

U.S. PATENT DOCUMENTS 4,344,314 * 8/1982 Aldrich et al. ..... 72/705
4,510,790 * 4/1985 Hare ..... 72/705
4,557,127 * 12/1985 Pietrelli ..... 72/705
5,884,399 * 3/1999 Bergstrom et al. ..... 33/608

* cited by examiner

*Primary Examiner*—Lowell A. Larson
(74) *Attorney, Agent, or Firm*—Ernest Kettelson

(57) ABSTRACT

A modular mobile bench for supporting a vehicle chassis comprises a modular frame and a plurality of modular fixture holders supported on such frame having fixtures pick-up points on the chassis or vehicle body that is to be suported thereon. The modular frame and fixture holders are constructed and arranged in such a way they can support the entire vehicle chassis in any desired position, upright, upside-down, on either side, on either end, one portion of the vehicle elevated relative to another portion, and at various desired angles and attitudes for working on the vehicle chassis as well as for design purposes.

16 Claims, 7 Drawing Sheets

MODULAR MOBILE AUTOMOTIVE DESIGN BRANCH

FIELD OF THE INVENTION

This invention relates to the field of support structures for holding a vehicle chassis on which work is to be done, such as designing a new vehicle body or chassis, assembling component parts thereto, and the like. The support structure in this case is modular, in that its component parts may be readily assembled and disassembled, as well as being mobile, having wheels whereby it can be readily rolled from one location to another.

BACKGROUND OF THE INVENTION

The modular mobile bench in accordance with this invention and the fixture holders which are releasably and adjustably securable thereto are an improvement over the prior art. The component parts are releasably connected and provide for virtually universal adjustment of the chassis supporting fixtures, horizontally, vertically and radially, to be able to engage and support virtually any point of a vehicle chassis that is to be supported or designed on the modular mobile bench. Such locations of the chassis supporting fixtures can also be easily and readily changed when the modular mobile bench in accordance with this invention is to be used to support or design a different vehicle chassis.

Prior, art devices of which the inventor is aware include those disclosed in two of the inventor's own previously issued patents and the references cited therein, as follows:

U.S. Pat. No. 4,573,337 (Papesh)

U.S. Pat. No. 4,067,222 (Eck)

U.S. Pat. No. 4,238,951 (Grainger et al)

U.S. Pat. No. 4,404,838 (Hare)

U.S. Pat. No. 5,016,465 (Papesh)

U.S. Pat. No. 4,510,790 (Hare)

U.S. Pat. No. 4,720,991 (Kuhn)

U.S. Pat. No. 4,823,589 (Maxwell, Jr.)

Australia Patent No. 249,933

French Patent No. 2,246,322

PCT Int'l Patent No. 8,707,191

SUMMARY OF THE INVENTION

The modular mobile bench in accordance with the present invention provides an easily adjustable support structure for holding and designing an almost infinite variety of vehicle chassis and vehicle bodies. It has a basic support frame comprising a pair of longitudinal support bars that may be easily moved closer together or farther apart by their slidable connections at each end to respective ones of a pair of lateral support bars. The basic support frame is mounted on four wheels making it easily movable from one location to another with a vehicle chassis supported therein, such as moving from one work station or inspection station to another.

Modular fixture holders are provided, a plurality of which may be releasably mounted on the longitudinal and lateral support bars and slidably moved thereon to any desired location. The fixture holders receive chassis engaging fixture members to engage and support selected pick-up points of the vehicle chassis or new design to be supported on the mobile bench. The fixture holders include a releasable and slidable connecting bracket for releasable and slidable mounting on one of the longitudinal or lateral support bars of the frame. A lateral arm is pivotally connected to the connecting bracket by a pivot pin or bolt which can be clamped down to hold the lateral arm in a selected position. The lateral arm of the fixture holder has an elongated slot through which the pivot bolt extends, whereby the lateral arm may slide relative to the pivot bolt and connecting bracket to provide for horizontal adjustment of the fixture holder.

The lateral arm can also be pivoted on the pivot bolt, to provide for radial adjustment of the fixture holder.

An upright member is slidably connected to one end of the lateral arm of the fixture holder to provide for vertical adjustment of the fixture holder and the chassis engaging fixture members received in a recess at the upper end of the upright member. The upright member extends through a connecting aperture adjacent one end of the lateral arm. A plurality of spaced apart apertures are provided through the upright member, and a pin is provided to extend through the aperture just above the surface of the lateral arm when the upright member has been raised or lowered to a selected vertical position. The pin is inserted through such aperture to then bear against the surface of the lateral arm and thus hold the upright arm in its selected vertical position.

Interchangeable fixture members are provided to seat in the receiving recess at the upper end of the upright member of the fixture holder. Such fixture members may be of the pin type, and several may be provided ranging from large diameter pins to small diameter pins, depending on which are suitable for the particular pick-up point on the vehicle chassis that such fixture member is to engage and support. Other interchangeable fixture members may have a bearing plate and a broad planar surface for engaging and supporting a chassis pick-up point where that type of fixture would be appropriate. Still other interchangeable fixture members include a clamp member, for clamping engagement of a portion of a vehicle chassis.

In addition to holding the vehicle chassis, the fixture members may also be used to hold individual components of an automobile such as the engine, the transmission, the entire drive train by itself, and the like. This feature makes the improved mobile bench in accordance with this invention particularly useful in performing its design function.

Other features and advantages of the modular mobile bench in accordance with this invention will become apparent from the more detailed description which follows and from the accompanying drawings.

DESCRIPTION OF PREFERRED EMBODIMENT

Figure 1:
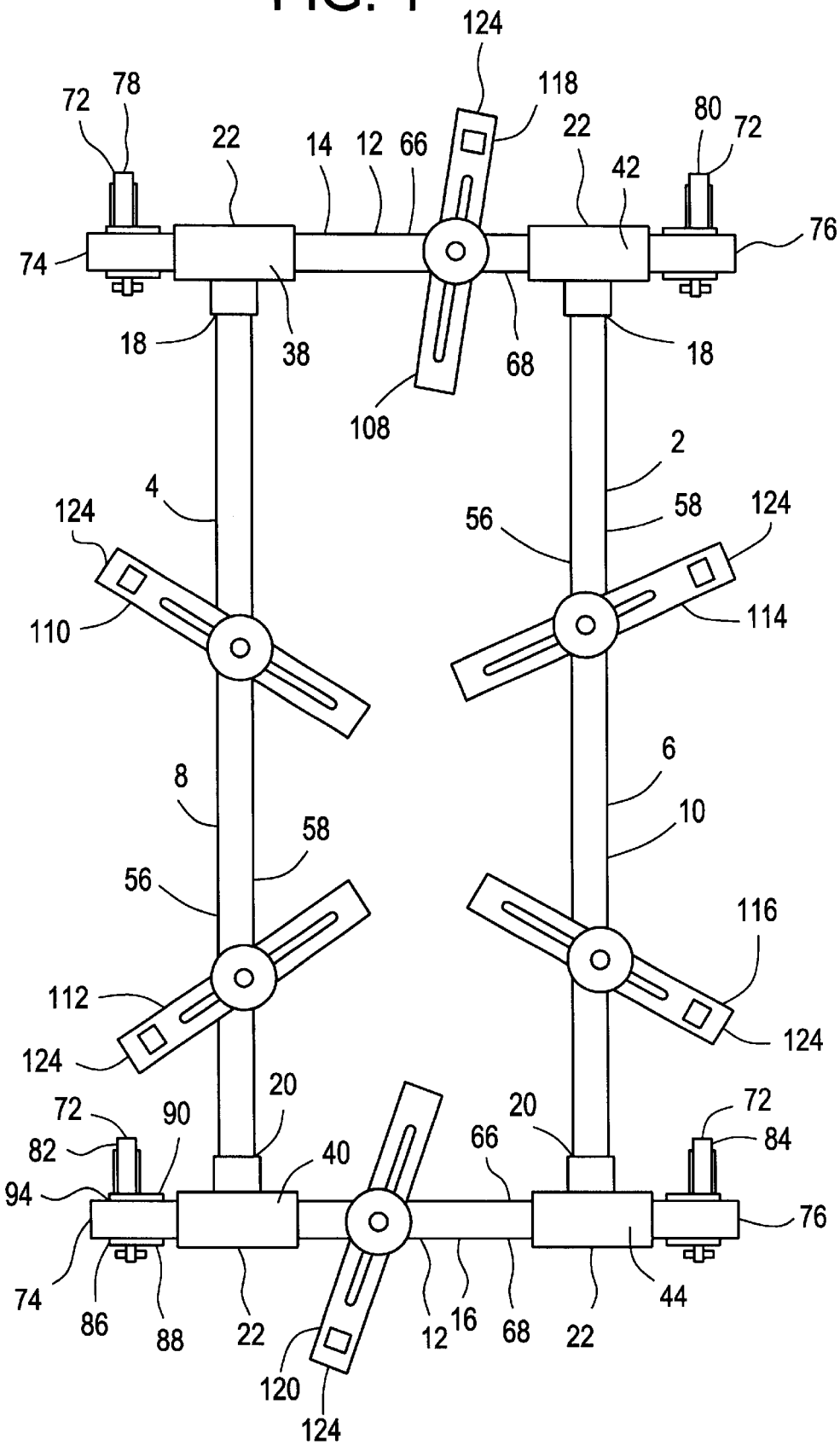
FIG. 1 is a plan view of a modular mobile bench in accordance with this invention.
Figure 2:
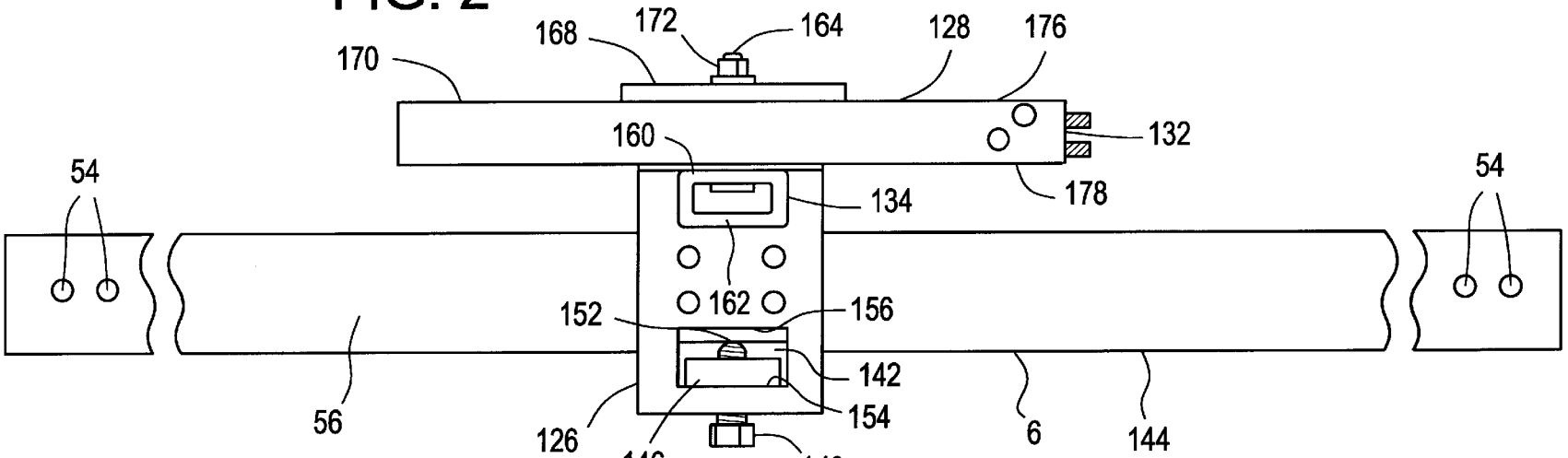
FIG. 2 is a side elevation view of a pivotable fixture holder shown slidably mounted on a longitudinal support bar of the modular mobile bench shown in FIG. 1.
Figure 3:
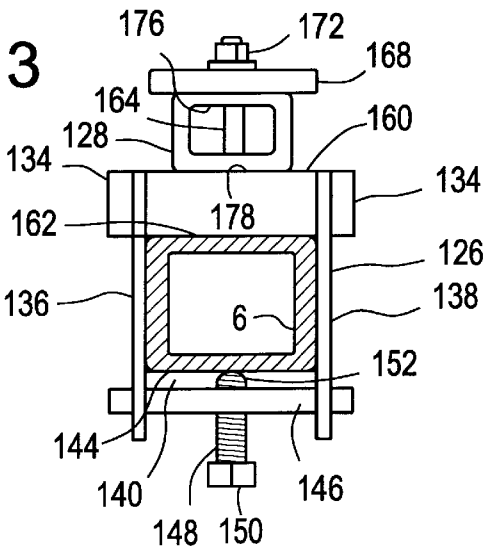
FIG. 3 is an end elevation view of a pivotable fixture holder as shown in FIG. 2 with the longitudinal support bar shown in section.
Figure 7:
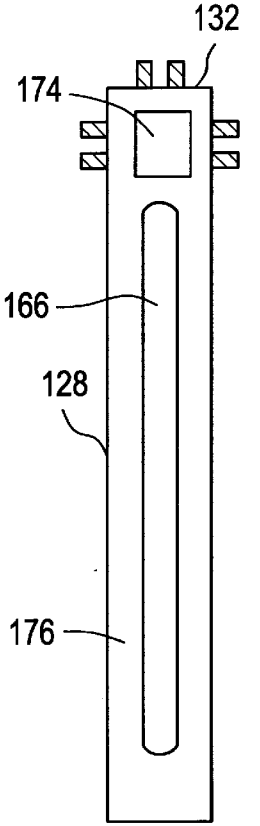
FIG. 7 is a plan view of the slidable bar portion of the fixture holder in accordance with this invention.
Figure 5:
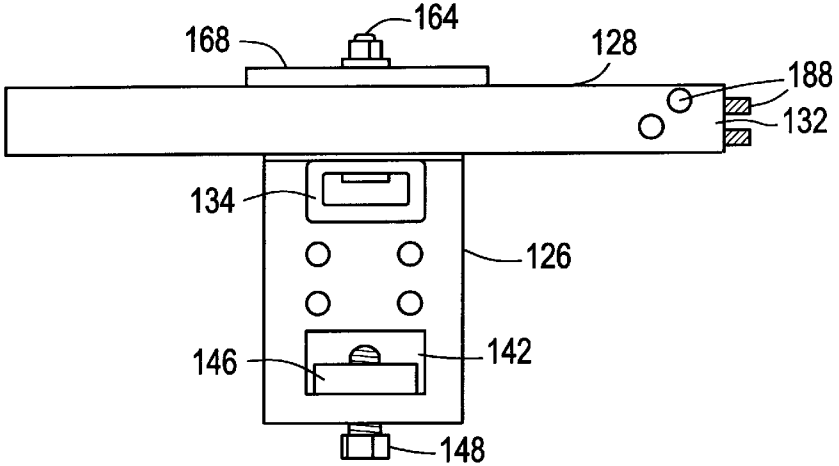
FIG. 5 is a side elevation view of a connecting bracket which connects the fixture holders to the support bars.
Figure 6:
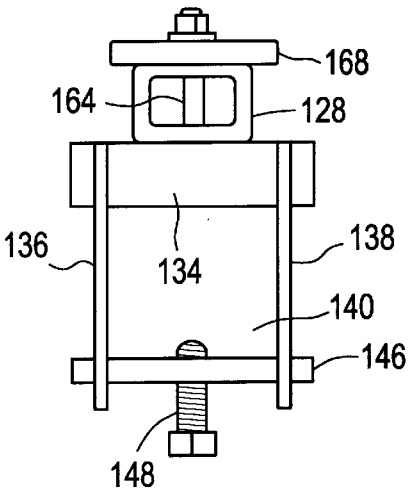
FIG. 6 is an end elevation view of a connecting bracket as shown in FIG. 5.
Figure 4:
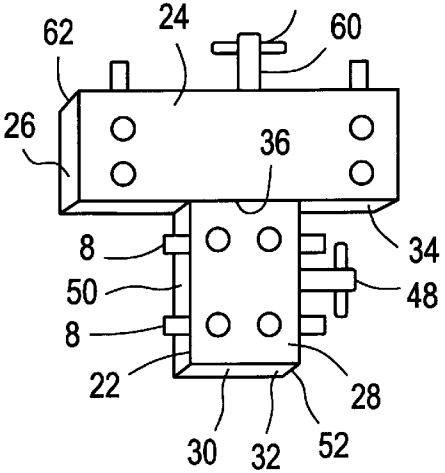
FIG. 4 is a perspective view of a connector sleeve member which connects a longitudinal support bar to a lateral support bar.
Figure 8:
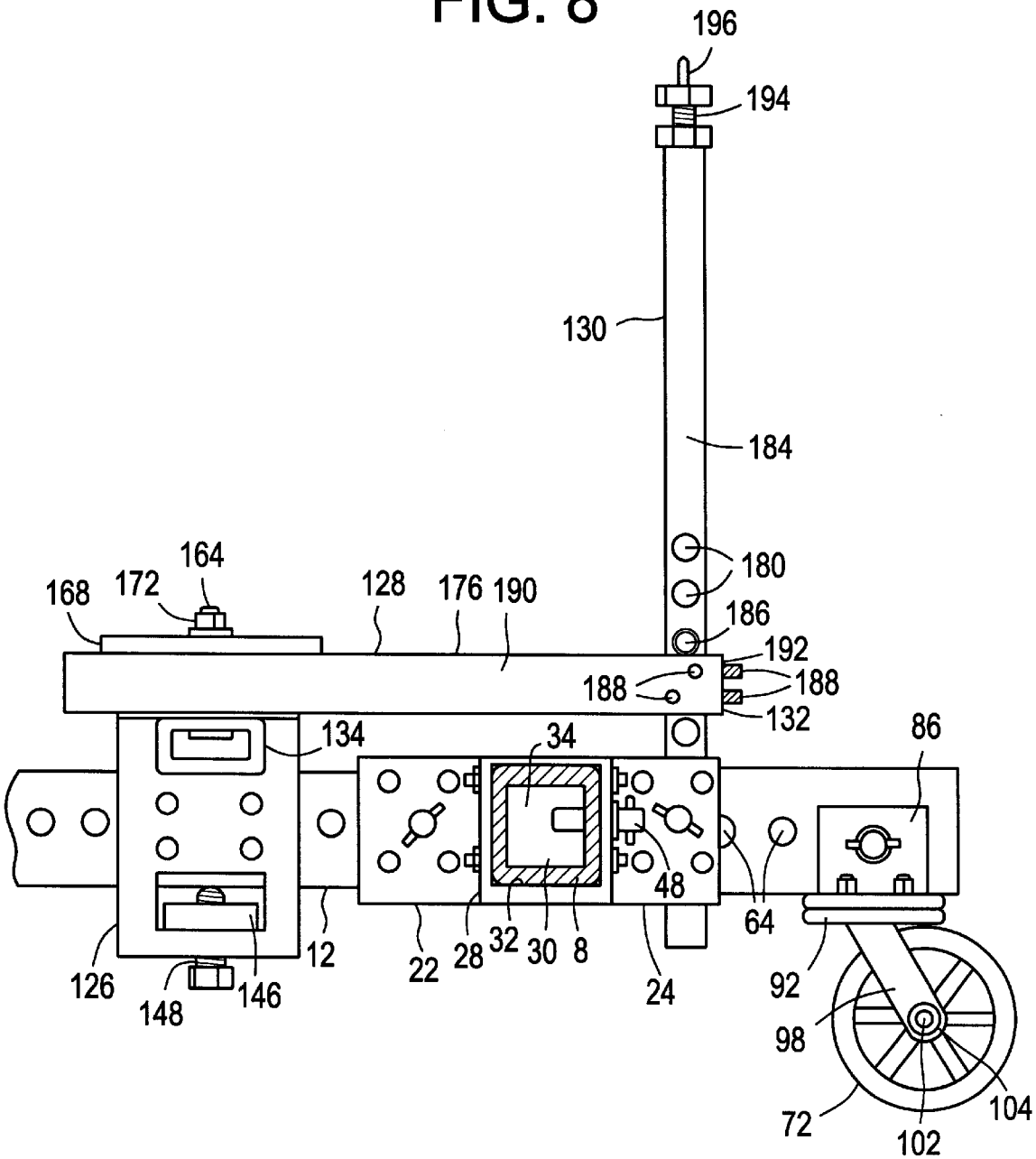
FIG. 8 is a side elevation view of a portion of a lateral support bar with a fixture holder in place thereon, and a longitudinal support bar shown in section received in a connector sleeve member as shown in FIG. 4.
Figure 9:
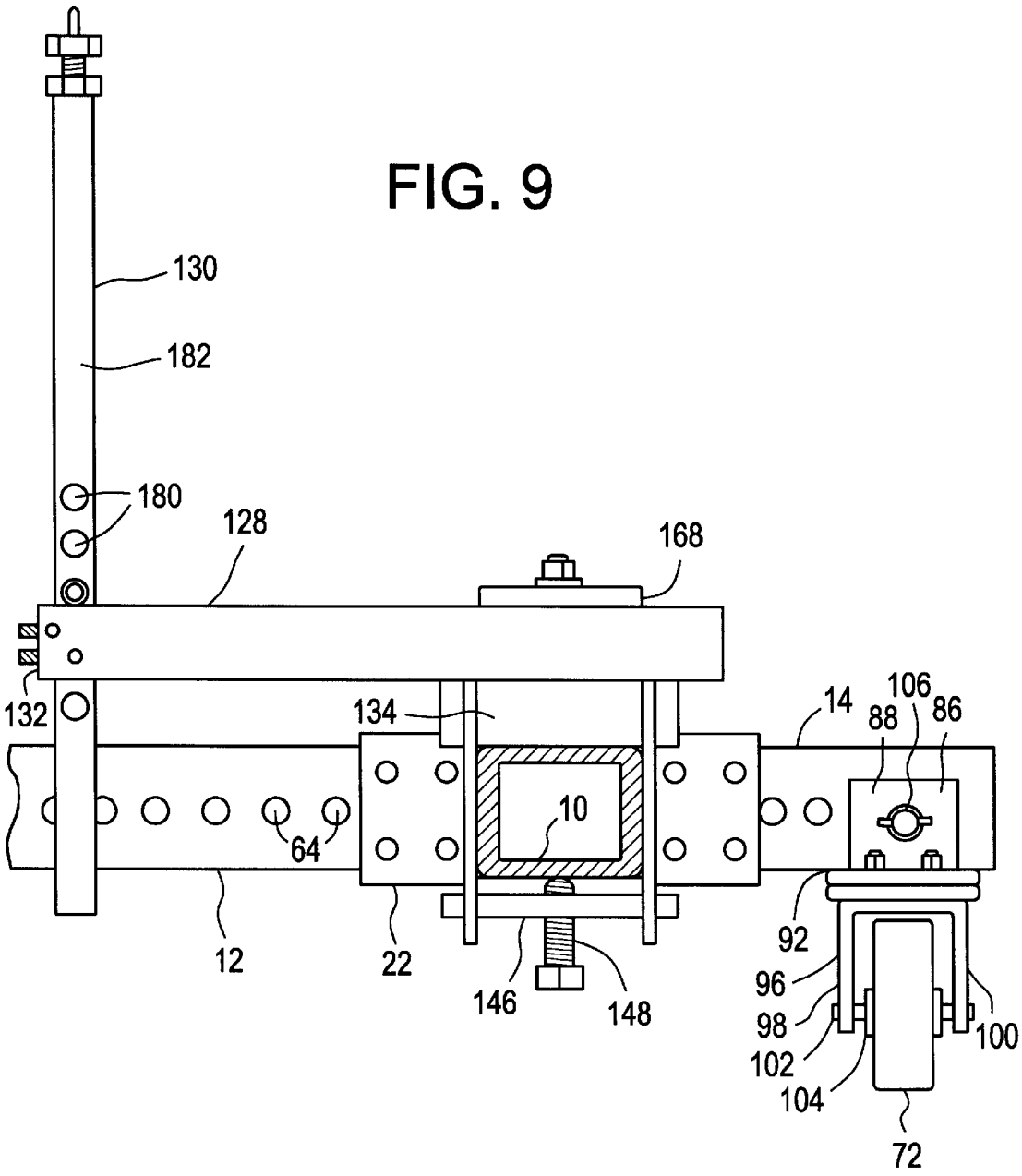
FIG. 9 is a side elevation view of a portion of a lateral support bar having a longitudinal support bar shown in section connected thereto by a connector sleeve member and a fixture holder shown secured to the longitudinal support bar.
Figure 10:
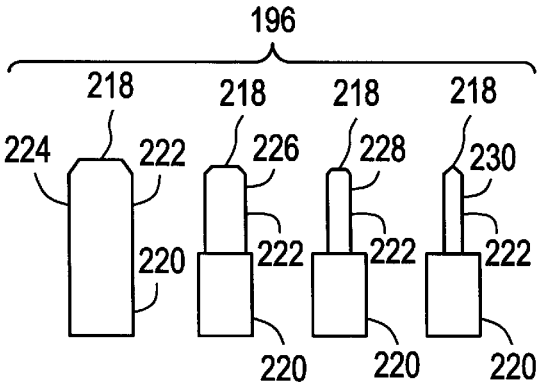
FIG. 10 is a side elevation view of a set of pin fixtures for mounting at the top of the vertical support member of the fixture holder to seat in or engage various ones of the pick-up points of a vehicle chassis to be supported on the modular mobile bench.
Figure 12:
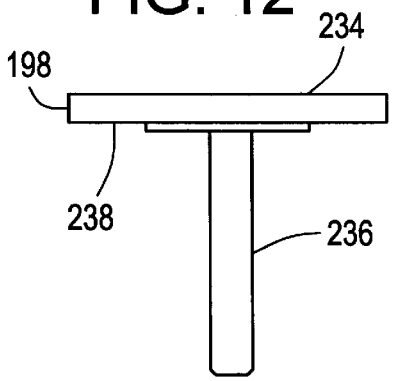
FIG. 12 is a side elevation view of a base plate fixture whose insert shaft is receivable in the central cavity of the threaded fixture assembly shank shown in FIG. 11 and 13.
Figure 11:
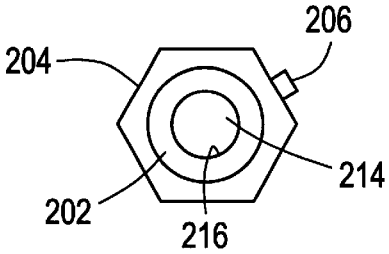
FIG. 11 is a plan view of one of the threaded fixture assembly shanks and its central cavity in which the insert shafts of respective ones of the pins shown in FIG. 10 or other fixture members may be received.
Figure 13:
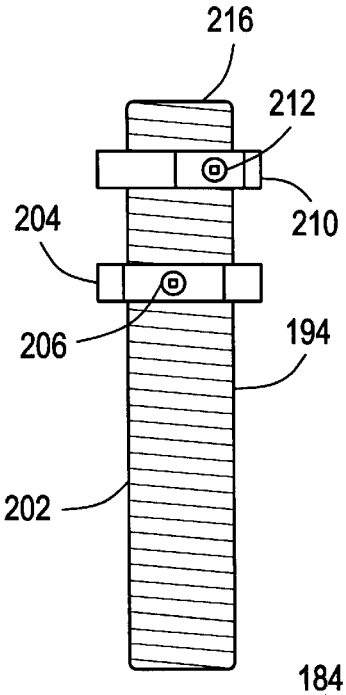
FIG. 13 is a side elevation view of the threaded fixture shank assembly shown in FIG. 11.
Figure 14:
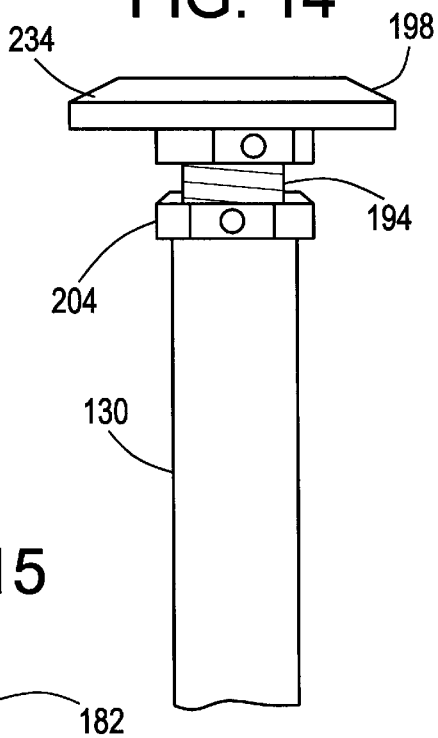
FIG. 14 is a perspective view of a base plate fixture received in the threaded fixture assembly shank shown in FIGS. 11 and 13 which in turn is received in the open upper end of a vertical support member, part of which is shown cut away.
Figure 15:
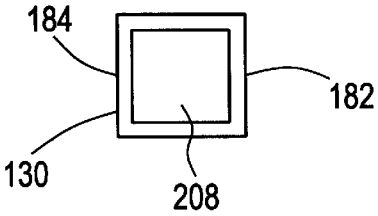
FIG. 15 is a plan view from above of a vertical support member to illustrate the opening to its tubular cavity.
Figure 16:
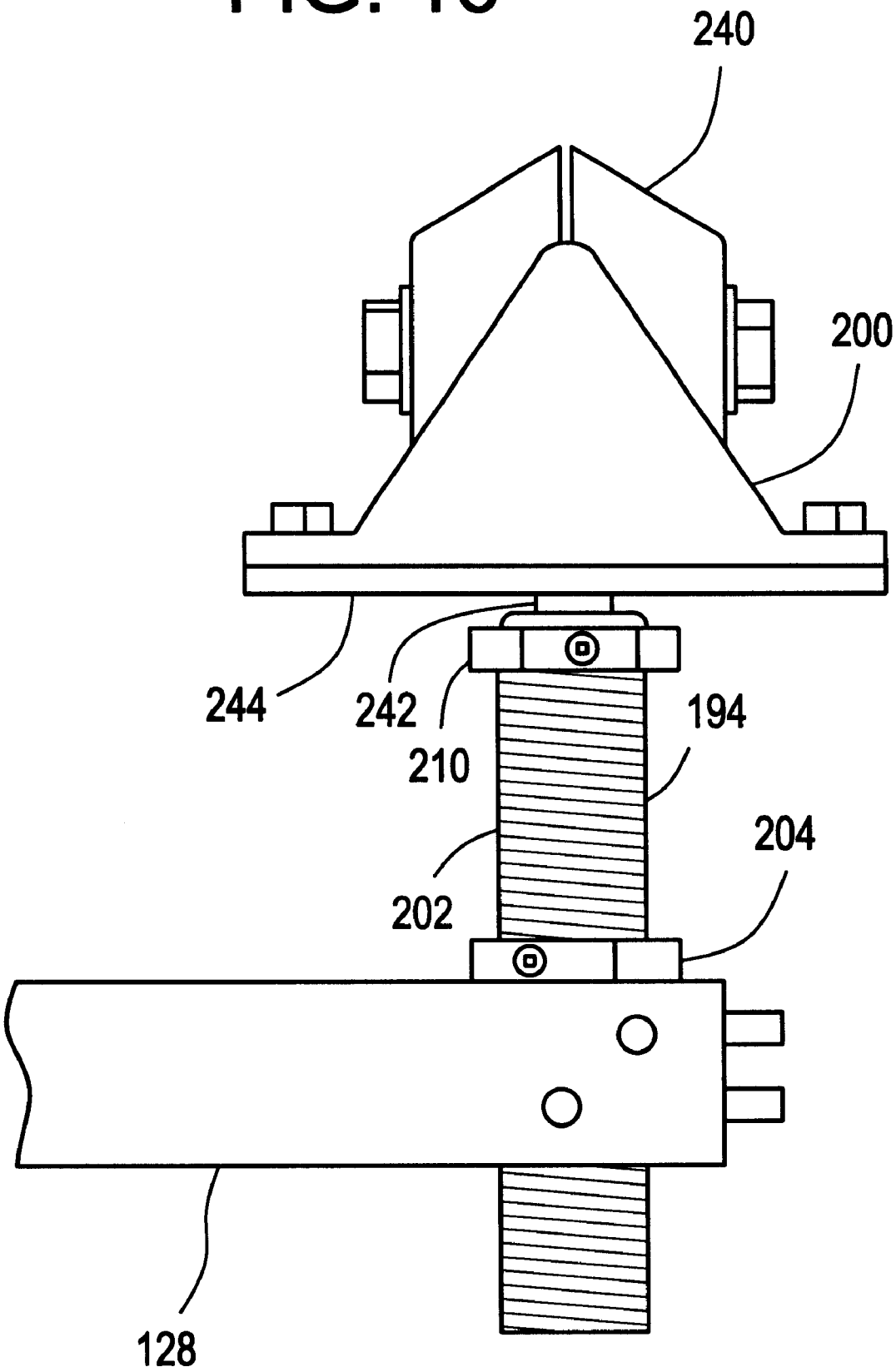
FIG. 16 is a side elevation view of a clamp fixture whose insert shaft is received in the central cavity of the threaded fixture assembly shank which in this case is received in and through the aligned rectangular apertures of the fixture holder's slidable bar, which for other uses of the modular mobile bench receive the vertical support member.

A modular mobile bench 2 in accordance with this invention comprises a support frame 4 having a pair of longitudinal support members 6 including a first longitudinal support member 8 and a spaced apart second longitudinal support member 10 extending parallel to the support member 8, and a pair of laterally extending support members 12 including a first lateral support member 14 and a spaced apart second lateral support member 16 extending parallel to the lateral support member 14.

Lateral support member 14 extends across the space between longitudinal support members 8 and 10 at one end 18 thereof. Lateral support member 16 extends across the space between longitudinal support members 8 and 10 at the opposite end 20 thereof.

The support members 8, 10, 12 and 14 are tubular, of generally square cross-sectional configuration. The longitudinal support members 8 and 10 are connected to the lateral support members 12 and 14 at their respective ends 18 and 20 by connector sleeves 22. Each connector sleeve 22 includes a lateral tubular section 24 of generally square cross-sectional configuration having a generally square through passageway 26 extending therethrough, and a longitudinal tubular section 28 of generally square cross-sectional configuration having a generally square receiving passageway 30 extending therein from an open entrance wall 32 at one end to abut against side wall 34 of the lateral tubular section 24 at the opposite end 36. The longitudinal tubular section 28 of each connector sleeve 22 is welded or otherwise secured to side wall 34 of the lateral tubular section 24 at the end 36 of longitudinal tubular section 28.

The end 18 of longitudinal support member 8 is received in receiving passageway 30 of one connector sleeve 38, and its opposite end 20 is received in receiving passageway 30 of a second connector sleeve 40. The end 18 of longitudinal support member 10 is received in receiving passageway 30 of a third connector sleeve 42, and its opposite end 20 is received in receiving passageway 30 of a fourth connector sleeve 44.

Lateral support member 14 is received through the laterally extending through passageways 26 of connector sleeves 38 and 42 at their connections to longitudinal support members 8 and 10 at their ends 18. Lateral support member 16 is received through the laterally extending through passageway 26 of connector sleeves 40 and 44 at their connections to longitudinal support members 8 and 10 at their ends 20.

A securing pin 48 extends through aligned apertures of side walls 50 and 52 of the longitudinal tubular section 28 of each connector sleeve 22 to secure the end portion of the longitudinal support members in the receiving passageway 30 thereof when received therein. Each end portion of each longitudinal support member 8 and 10 includes aligned apertures 54 through opposite side walls 56 and 58 thereof to receive a securing pin 48 therethrough when such end portion is received in the receiving passageway 30.

A threaded securing bolt 60 is threaded through side wall 62 of the lateral tubular section 24 of each connector sleeve 22 to seat in one of a plurality of laterally spaced apart positioning apertures 64 through side walls 66 and 68 of each lateral support member 14 and 16.

The longitudinal support member 8 and 10 can thus be moved closer together or spaced farther apart by sliding the sleeve connectors 22 at each of the respective ends 18 and 20 of the longitudinal support members 8 and 10 along the lateral support members 14 and 16 until the securing bolt 60 through side wall 62 of the lateral tubular section of each connector sleeve 22 comes into registration with selected ones of the positioning apertures 64 through side walls 66 and 68 of each lateral support member 14 and 16. The threaded securing bolt 60 is then rotated by its handle 70 to extend the bolt into the positioning aperture 64 thereby securing the longitudinal support members 8 and 10 in whatever spaced apart position desired.

Four transport wheels 72 are connected to respective outer ends 74 and 76 of each lateral support member 14 and 16 to enable rolling the modular mobile bench from one location to another, including a first transport wheel 78 connected to outer end 74 of lateral support member 14, a second transport wheel 80 connected to outer end 76 of such lateral support member 14, a third transport wheel 82 connected to outer end 74 of lateral support member 16 and a fourth transport wheel 84 connected to outer end 76 of such lateral support member 16.

The transport wheels are connected to the lateral support members by U-shaped bracket assembly 86, comprising a pair of spaced apart bracket walls 88 and 90 extending upwardly from a laterally extending base plate 92, defining a receiving cavity 94 therebetween to receive an end portion of a respective one of the lateral support members 14 and 16. A clevis 96 is pivotally connected at its bight portion to the downwardly facing side of the plate 92, a transport wheel 72 being received between the downwardly extending spaced apart legs 98 and 100 of the clevis, and an axle rod 102 extending through the end portions of the clevis legs and hub 104 of the transport wheel 72. A securing pin 106 extends through bracket wall 88 to seat in one of the positioning apertures 64 of the lateral support member received in the receiving cavity 94 of the transport wheel bracket assembly 86 to hold it in the selected position on the lateral support member.

A plurality of fixture holders 108 are provided for mounting on the longitudinal support members 8 and 10 and on the lateral support members 14 and 16 of the modular mobile bench as desired, including a first fixture holder 110 mounted toward one end of longitudinal support member 8, a second fixture holder 112 mounted toward the opposite end of longitudinal support member 8, a third fixture holder 114 mounted toward one end of longitudinal support member 10, a fourth fixture holder 116 mounted toward the opposite end of longitudinal support member 10, a fifth fixture holder 118 mounted at an intermediate location on lateral support member 14 and a sixth fixture holder 120 mounted at an intermediate location on lateral support member 12. The chassis of a vehicle may be supported on the fixture holders 110, 112, 114, 116, 118 and 120. The support ends 124 of the fixture holders are movable to any selected position within the space bounded by the lateral and longitudinal support arms 8, 10, 14 and 16 of the support frame 4 of the modular mobile bench 2, and to any selected position within the space bounded by the chassis of a vehicle to be supported thereon.

Each of the fixture holders 108 include a releasable connecting bracket 126, a laterally extending slidable bar 128 slidably mounted on the connecting bracket and extendable laterally therefrom, and an adjustable upright bar 130 extendable upwardly and downwardly from an end 132 of the laterally extending bar 128.

Each releasable connecting bracket 126 comprises an inverted. U-shaped bracket structure having an upper cross bar member 134 and a pair of spaced apart downwardly extending side wall members 136 and 138 defining a receiving cavity 140 therebetween to receive one of the support members of the support frame 4 therein.

The side wall member 136 and 138 are longer than the corresponding dimension of the pairs of support members 6 and 12, having aligned spaced apart rectangular apertures 142 through the portions of side wall members 136 and 138 which extend below the bottom wall 144 of the tubular support members 6 and 12. A bearing plate 146 extends through the spaced apart rectangular apertures 142 of side wall members 136 and 138. A threaded bolt 148 extends through a threaded aperture in the center of the bearing plate 146, its bolt head 150 below the bearing plate and its free end 152 extending above for bearing engagement against the bottom wall 144 of the support member on which the connecting bracket 126 is mounted when the bolt 148 is tightened. At such time, the bearing plate 146 bears against the bottom edge 154 of the rectangular apertures 142, thereby clamping the releasable connecting bracket 126 securely to the support member.

The upper edge 156 of the rectangular apertures 142 is spaced apart from the bottom edge 154 a distance greater than the cross-sectional thickness of the bearing plate 146. This provides clearance when bolt 148 is loosened so the releasable connecting bracket 126 can slide freely along the support member to a new position.

The releasable connecting brackets 126 may be removed completely from the support members by sliding the bearing plate out from the rectangular apertures 142, whereupon the connecting brackets 126 can be lifted off from the support members.

The upper cross bar member 134 of connecting bracket 126 has a rectangular tubular cross-section, comprising an upper wall 160 and a lower wall 162. The lower wall 162 of the cross bar member 134 bears against the upper surface of the support member when in position thereon. A connecting bolt 164 extends upwardly from the upper wall 160 of the cross bar member to extend through the elongated spaced apart aligned slots 166 of laterally extending slidable bar 128 for connection thereof to the releasable connecting bracket 126.

A large diameter washer 168 is placed on the connecting bolt 164 above the upper surface 170 of the laterally extending bar 128 to clamp it securely in a selected position when the nut 172 is tightened down on the connecting bolt 164.

When the nut 172 is loosened, the bar 128 is slidable on the connecting bolt 164 which extends through the aligned elongated slots 166 to a new selected position.

The laterally extending slidable bar 128 has a pair of aligned rectangular apertures 174 through the upper wall 176 and lower wall 178 thereof adjacent its upright bar connecting end 132. The adjustable upright bar 130 is received through the aligned rectangular apertures 174.

The adjustable upright bar 130 is of rectangular tubular cross-section, having a plurality of longitudinally spaced apart height adjusting aligned apertures 180 through the spaced apart opposing side walls 182 and 184. A pin 186 is received through apertures 180 at a selected height location to bear against the upper wall 176 of the laterally extending slidable bar 128.

Set screws 188 are provided through side walls 190 and end wall 192 of the laterally extending bar 128 positioned to bear against and stabilize the upright bar 130.

A variety of fixture members may be used with the fixture holder assembly 194, including a pin fixture member 196, a base plate fixture member 198, and a clamp fixture member 200.

Each of the fixture members 194 include a threaded shank 202 having a first positioning nut 204 threaded thereon. A set screw 206 extends through the nut 204 to bear against the shank 202 when the nut has been rotated and adjusted to a desired pre-selected position on the shank. A portion of the shank 202 which extends below the nut 204 is inserted into the opening 208 to the cavity of the tubular upright bar 130, with the positioning nut 204 bearing against the-upper edge of the upright bar 130.

A second nut 210 is threaded on the portion of the shank 202 which extends upwardly from the first nut 204. A set screw 212 extends through the second nut 210 to bear against the shank 202 when that nut has been rotated and adjusted to its selected position. The threaded shank 202 has a cylindrical recess 214 extending downwardly therein from its upper end and its opening 216.

The pin fixture assembly 196 includes a plurality of pins 218 whose base portions 220 are receivable in the cylindrical recess 214 of the threaded shank 202. The pins 218 include an upwardly extending insert portion 222. The insert portion 222 of pin 224 has a diameter of the same dimension as the diameter of the base portion 220. The insert portion 222 of pin 226 has a slightly smaller diameter, that of pin 228 still smaller and that of pin 230 smaller than that of pin 228. Any number of pins having insert portions of any desired diameter may be provided. The insert portions are receivable in selected pick-up points of the chassis of a vehicle that is to be received on the fixture holder assemblies mounted on the support frame of the modular mobile bench.

The diameters of the insert portions to be used are selected to correspond with the diameter of the recess of the pick-up point in which the insert portion is to be received.

The base plate fixture assembly 198 includes a base plate 234 having an insert member 236 extending from its downwardly facing surface 238 for reception in the recess 214 of the shank 202.

The clamp fixture assembly 200 includes a clamp member 240 having an insert member 242 extending downwardly from its base 244 for reception in the recess 214 of the shank 202.

I claim:

1. A modular mobile bench for supporting or designing a vehicle chassis, comprising a first longitudinally extending bar member, a second longitudinally extending bar member, a first laterally extending bar member, a second laterally extending bar member, first bar connection means to connect said first and second longitudinally extending bar members to said first laterally extending bar member, second bar connection means to connect said first and second longitudinally extending bar member to said second laterally extending bar member, said first and second bar connection means including lateral adjustment means for movement of at least one of said first and second longitudinally extending bar members laterally of at least one of said first and second laterally extending bar members, a plurality of spaced apart vehicle chassis support members extending upwardly from at least two of said longitudinally and laterally extending bar members positioned to receive the entire portion of said vehicle chassis thereon and support said entire portion of said vehicle chassis at spaced apart locations thereof, each of said vehicle chassis support members including chassis engaging fixture means to engage, bear against and support a selected part of said vehicle chassis, each of said vehicle chassis support members including adjustable positioning means to adjust and position said chassis engagement fixture means of each of said vehicle chassis support members in both horizontal and vertical directions relative to a said bar member on which said vehicle chassis support member is positioned whereby said vehicle chassis thereon may be positioned with one end thereof higher than the other, one side thereof higher than the other, one end and one side thereof together higher than the other end and other side together, spaced apart portions of only one side of said vehicle chassis may be supported on said adjustable positioning means to view and work on the top and bottom portions of said vehicle chassis, and spaced apart portions of only one end of said vehicle chassis may be supported on said adjustable positioning means to view and work on the top and bottom portions of said vehicle chassis together with both sides thereof accessible at the same time, said adjustable positioning means including rotatable bar means rotatable continuously three hundred and sixty degrees in both directions of rotation in a horizontal plane and clamp means to clamp and hold said rotatable bar means to a said bar member on which said vehicle chassis support member is positioned when rotated to a selected position thereon, and vertically extendible, vertical adjustable bar means slidably securable to said rotatable bar means for sliding movement above and below said horizontal plane in which said rotatable bar means rotates, and transport means on said modular mobile bench to move it from one location to another.

2. A modular mobile bench for supporting or designing a vehicle chassis as set forth in claim 1, wherein said adjustable positioning means includes universal adjustable positioning means to position said chassis engagement fixture support members in all horizontal and in both vertical directions relative to a said bar member on which said vehicle chassis support member is positioned.

3. A modular mobile bench for supporting or designing a vehicle chassis as set forth in claim 1, wherein said transport means include a plurality of wheels.

4. A modular mobile bench for supporting or designing a vehicle chassis as set forth in claim 1, wherein said first bar connection means includes a first connecting member having a sleeve to receive one end of said first longitudinally extending bar member therein and a second connecting member having a sleeve to receive one end of said second longitudinally extending bar member therein.

5. A modular mobile bench for supporting or designing a vehicle chassis as set forth in claim 4, wherein said second bar connection means includes a third connecting member having a sleeve to receive the other end of said first longitudinally extending bar member therein and a fourth connecting member having a sleeve to receive the other end of said second longitudinally extending bar member therein.

6. A modular mobile bench for supporting or designing a vehicle chassis as set forth in claim 5, wherein said lateral adjustment means of said first and second bar connection means comprises a through passageway of said first connecting member to slidingly receive said first laterally extending bar member therethrough, a through passageway of said second connecting member to slidingly receive said first laterally extending bar member therethrough, a through passageway of said third connecting member to slidingly receive said second laterally extending bar member therethrough, and a through passageway of said fourth connecting member to slidingly receive said second laterally extending bar member therethrough.

7. A modular mobile bench for supporting or designing a vehicle chassis as set forth in claim 1, wherein said plurality of vehicle chassis support members includes a first vehicle chassis support member, said adjustable positioning means of said first vehicle chassis support member include a releasable bracket member to slidably and releasably receive a said bar member, said releasable bracket member including tightening means to hold said releasable bracket member securely at a selected location on said bar member, said releasable bracket member being slidable in a horizontal direction on said bar member when said tightening means has been loosened.

8. A modular mobile bench for supporting or designing a vehicle chassis as set forth in claim 7, wherein said releasable bracket member includes a cross bar, a pair of spaced apart side walls extending downwardly from opposite ends of said cross bar a distance greater than the corresponding dimension of said bar member on which it is positioned to provide an overhang portion, aligned apertures through said overhang portion of said side walls of said bracket member, said tightening means including a bearing plate received through said aligned apertures, a bolt threaded through said bearing plate rotatable in one direction to tighten and in the opposite direction to loosen, the free end of said bolt engaging and bearing against the underside of said bar member on which said bracket member is positioned when rotated in the direction to tighten, the free end of said bolt retracting from the underside of said bar member when rotated in the opposite direction to loosen.

9. A modular mobile bench for supporting or designing a vehicle chassis as set forth in claim 7, wherein said rotatable arm means of said adjustable positioning means of said first vehicle chassis support member includes an elongated positioning arm pivotally mounted on said releasable bracket member and extending laterally therefrom, said elongated positioning arm including an elongated slot therein, a pivot pin extending upwardly from said releasable bracket member and through said elongated slot of said elongated positioning arm to terminate at a free end above the surface of said elongated positioning arm, said clamp means including a clamp member operatively associated with said free end of said pivot pin to releasably clamp and hold said elongated positioning arm at a selected position relative thereto and to said releasable bracket member, said elongated positioning arms being slidable laterally relative to said pivot pin received in said elongated slot in addition to being pivotable around said pivot pin.

10. A modular mobile bench for supporting or designing a vehicle chassis as set forth in claim 9, wherein said vertically extendible vertically adjustable bar means of said adjustable positioning means of said first vehicle chassis support member includes an elongated upright member extending vertically from said laterally extending elongated positioning arm adjacent one end thereof, vertically adjustable connecting means to connect said elongated upright member to said elongated positioning arm for vertical adjustment of said elongated upright member relative to said laterally extending elongated positioning arm and to releasably hold said elongated upright member at a selected vertical position relative to said laterally extending elongated positioning arm, said elongated upright member extending upwardly from said laterally extending positioning arm to terminate at an upper end, said chassis engaging fixture means being positioned at said upper end of said elongated upright member.

11. A modular mobile bench for supporting or designing a vehicle chassis as set forth in claim 10, wherein said chassis engaging fixture means include a pin fixture member comprising a releasable connecting portion for releasable connection to said upper end of said elongated upright member and a pin portion including a pin extending upwardly therefrom for engagement with a selected portion of a chassis to be supported on said modular mobile bench.

12. A modular mobile bench for supporting or designing a vehicle chassis as set forth in claim 10, wherein said chassis engaging fixture means include a bearing plate fixture member comprising a releasable connecting portion for releasable connection to said upper end of said elongated upright member and a bearing plate portion, including a bearing plate having a bearing surface facing upwardly for bearing engagement with a selected portion of a chassis to be supported on said modular mobile bench.

13. A modular mobile bench for supporting or designing a vehicle chassis as set forth in claim 10, wherein said chassis engaging fixture means include a clamp fixture member comprising a releasable connecting portion for releasable connection to said upper end of said elongated upright member and a clamp portion, including a clamp comprising jaw members movable between a clamping position and a release position to clamp and hold a selected portion of a chassis to be supported on said modular mobile bench.

14. A modular mobile bench for supporting or designing a vehicle chassis as set forth in claim 1, wherein said chassis engaging fixture means include a pin fixture member having a pin extending outwardly for engagement with a selected portion of a chassis to be supported on said modular mobile bench.

15. A modular mobile bench for supporting or designing a vehicle chassis as set forth in claim 1, wherein said chassis engagement fixture means include a bearing plate fixture member having a bearing plate and a bearing surface for bearing engagement with a selected portion of a chassis to be supported on said modular mobile bench.

16. A modular mobile bench for supporting or designing a vehicle chassis as set forth in claim 1, wherein said chassis engaging fixture means include a clamp fixture member having a jaw member movable between a clamping position and a release position to clamp and hold a selected portion of a chassis to be supported on said modular mobile bench.

* * * * *